US005367503A

United States Patent [19]

Lowrance

[11] Patent Number: 5,367,503

[45] Date of Patent: Nov. 22, 1994

[54] TURNSTILE GAME

[75] Inventor: Arlen J. Lowrance, Tulsa, Okla.

[73] Assignee: Carl J. Lowrance, Tulsa, Okla.

[21] Appl. No.: 201,124

[22] Filed: Feb. 24, 1994

Related U.S. Application Data

[63] Continuation-in-part of Ser. No. 131,004, Oct. 4, 1993, abandoned.

[51] Int. Cl.[5] ..... G04B 47/00; G04F 8/00; F41J 5/02

[52] U.S. Cl. ..... 368/10; 368/110; 273/375; 273/383; 273/390

[58] Field of Search ..... 368/3, 9, 10, 110–113; 273/343–350, 371, 375, 378, 383, 390

[56] References Cited

U.S. PATENT DOCUMENTS

| | | | |
|---|---|---|---|
| 3,463,494 | 8/1969 | Stroh | 273/345 |
| 4,976,439 | 12/1990 | Kraemer | 273/350 |
| 5,018,117 | 5/1991 | Lowrance | 368/10 |
| 5,068,837 | 11/1991 | Lowrance | 368/10 |
| 5,094,461 | 3/1992 | Lowrance | 273/343 |
| 5,180,170 | 1/1993 | Lowrance | 273/343 |
| 5,263,721 | 11/1993 | Lowrance | 273/390 |

*Primary Examiner*—Vit W. Miska
*Attorney, Agent, or Firm*—William S. Dorman

[57] ABSTRACT

A turnstile operated game for determining the elapsed time between a starting event and an ending event comprising a turnstile composed of a horizontal member supported above the ground, a vertical shaft rotatably mounted on the horizontal member, an arcuate cam mounted on the turnstile and being responsive to the rotation of the shaft, a microswitch mounted on the turnstile adjacent the cam, the microswitch having a toggle arm adapted to be contacted by the cam to actuate the microswitch upon a predetermined rotary movement of the shaft, a horizontal lever connected to the vertical shaft and having a first portion extending away from and beyond the horizontal member, the lever having a second portion extending on the opposite side of the shaft from the first portion thereof, a timer connected to the microswitch such that the timer is turned on when an object contacts and pivots the first portion of the lever, the contacting and pivoting of the first portion of the lever by the object constituting a starting event for the game, the completion of an ending event sending a signal to the timer to stop the same, thereby indicating the time elapsed between the starting event and the ending event.

10 Claims, 9 Drawing Sheets

TURNSTILE GAME

CROSS-REFERENCE TO RELATED APPLICATION

The present application is a continuation-in-part of prior application Ser. No. 08/131,004, filed on Oct. 4, 1993 and entitled "Turnstile Operated Game".

BACKGROUND OF THE INVENTION

1. Field of the Invention

The present invention relates to a game which involves determining the elapsed time between a starting event and an ending event. More particularly, the present invention relates to such a game where the starting event involves the pivoting of a horizontal wand or lever mounted on a turnstile such that the movement of the lever initiates a timer.

2. The Prior Art

In Lowrance U.S. Pat. No. 5,018,117, issued May 21, 1991 and entitled "Combined Racing Kite Gate and Quick Draw Device" there is disclosed a game apparatus wherein a vertical wand or lever is contacted by a moving kite string to pivot the wand and turn a cam; the rotation of the cam actuates an electronic switch which initiates the actuation of a timer; later, when the wand is again pivoted by the kite string in the same rotary direction, the microswitch will be again actuated to stop the timer. Between the first pivoting of the wand and the last pivoting of the wand which serve to start and stop the timer, respectively, the person who is operating the kite may perform, or be required to perform, intermediate operations with the kite; however, the total elapsed time between the first and second pivoting of the wand, in the same rotational direction, will indicate the total elapsed time for the operator of the kite to complete all of the required operations with the kite.

In Lowrance U.S. Pat. No. 5,068,837, issued Nov. 26, 1991 and entitled "Combined Racing Kite Gate and Quick Draw Device", there is disclosed a quick draw mechanism wherein a target is mounted on an end of a vertical wand or lever similar to the wand described above in reference to U.S. Pat. No. 5,018,117. When a missile, such as an arrow, bullet or baseball, hits the target in a given direction, the wand will pivot so as to rotate a cam and actuate a microswitch to start a timer. The shooter or thrower may attempt to operate a number of intermediate targets, after which he will again actuate the primary target on the wand so as to actuate the microswitch a second time to stop the timer.

Lowrance U.S. Pat. No. 5,094,461, issued Mar. 10, 1992 and entitled "Fishing Game Apparatus" discloses a vertical wand or lever which rotates a cam to operate a microswitch. A plurality of fish are mounted on a horizontal support. Two of the fish are connected by releasable lines to the lever. The game is commenced when the fisherman hooks one of the two target fishes and pulls it from the horizontal array, thereby actuating the microswitch to start the timer. The fisherman will then proceed to pull all of the intermediate fish from the horizontal array until only the second target fish remains. When the fisherman snares the second target fish, the cam will rotate against the microswitch to actuate it for a second time to stop the timer.

In the present invention the wand or lever is disposed for movement in a horizontal plane such as a turnstile. The wand or lever, however, is actuated by an object pivoting and/or passing through and beyond the wand, as in passing through a turnstile. The latter action starts the timer.

SUMMARY OF THE INVENTION

The present invention involves a game device whose principal component is a turnstile. The turnstile comprises a horizontal pipe which is suitably supported above the ground, for example, by a pair of vertical pipes. A vertical shaft is rotatably mounted on the horizontal pipe adjacent one end thereof. The vertical shaft has a lower end on which is mounted an arcuate cam. A microswitch is mounted on the horizontal pipe adjacent the cam. The microswitch has a toggle arm which is adapted to be contacted by the cam upon rotation of the shaft. The shaft has an upper end on which is mounted a horizontal lever or wand which extends to one side of the horizontal pipe, but in parallel relation thereto. This lever extends sufficiently away from the horizontal pipe that a person can come into contact with the lever, rotate the lever and then pass beyond the lever. This action constitutes the "starting" event, because the movement of the person through and beyond the lever will rotate the shaft and the cam so as to actuate the microswitch. A timer is connected to the microswitch such that its operation is commenced when the microswitch is actuated. After the person passes through and beyond the lever, he will find himself on the field where the game is to be played. This game, for example, can be soccer, frisbee, baseball or football. The person will kick or throw the object in question against a target. Assuming that the game in question is soccer, the person will locate the soccer ball and try to kick the soccer ball as quickly as possible against a target.

In one embodiment of this invention, the target comprises a horizontal rod which is suspended above the ground, preferably by a pair of vertical rods. A smaller U-shaped rod is pivotally connected at its upper ends to the upper ends of the vertical rods of the target member. A fabric sheet is supported between the upper corners of the target member and the lower corners of the pivotal U-shaped rod. One upper end of the U-shaped rod connects with a rotary shaft mounted adjacent the upper end of one of the vertical rods of the target member. On this same vertical rod of the target member there is mounted an arcuate cam similar to the arcuate cam mounted on the turnstile. There is also mounted a microswitch adjacent this cam in similar fashion to the mounting of the microswitch on the turnstile. Thus, when the person kicks the soccer ball against the fabric sheet so as to pivot the U-shaped rod, this second microswitch will be actuated to create a signal. The arrangement of this game is such that the signal created by the operation of the target will be sent to the timer so as to stop the operation of the timer. In this manner, the timer will show the elapsed time between the time the person passed through the turnstile and the time he kicked the soccer ball against the target member.

Obviously the person could kick a football against the target, or throw a football, baseball or frisbee against the target.

In order to provide an audible or visual indication of the starting and/or stopping of the game, a horn or flashing could be connected to the timer so as to be attached whenever the timer is actuated.

In another embodiment of this invention, the turnstile is combined with a target.

In a preferred embodiment of this invention, the turnstile is even further simplified. That is, the turnstile comprises a horizontal pipe which is suitably supported above the ground, for example, by a single vertical pipe which can be of varying length so that the wand (later to be described) is located adjacent the ground or is waist high or knee high. A vertical shaft is rotatably mounted on the horizontal pipe. The vertical shaft has an upper end on which is mounted an arcuate cam. A microswitch is mounted on the horizontal pipe adjacent the cam. The microswitch has a toggle arm which is adapted to be contacted by the cam upon rotation of the shaft. The shaft has a lower end upon which is mounted a horizontal lever which extends in parallel relation to the horizontal pipe, but to one side of the turnstile. This lever extends sufficiently away from the turnstile that a person or object can come in contact with the lever, rotate the lever, and then pass beyond the lever. This action constitutes the "starting" event because the pivoting of the lever will rotate the shaft and the cam so as to actuate the microswitch. A timer is connected to the microswitch such that its operation is commenced when the microswitch is actuated. The lever can be pivoted by a person directly, either walking or on skates; alternatively, the lever can be pivoted by a vehicle operated by a person, the vehicle being possibly a bicycle or boat or miniature car; as a still further alternative, the pipe can be sufficiently short that the lever is located adjacent the ground so as to be contacted by a radio controlled car, for example, to start the game. Obviously, two or more such turnstiles can be arranged in a spaced relation so that the person or object who goes through the first turnstile to start the game can also pass through the second turnstile to stop the game.

DETAILED DESCRIPTION OF THE PREFERRED EMBODIMENTS

Figure 1:
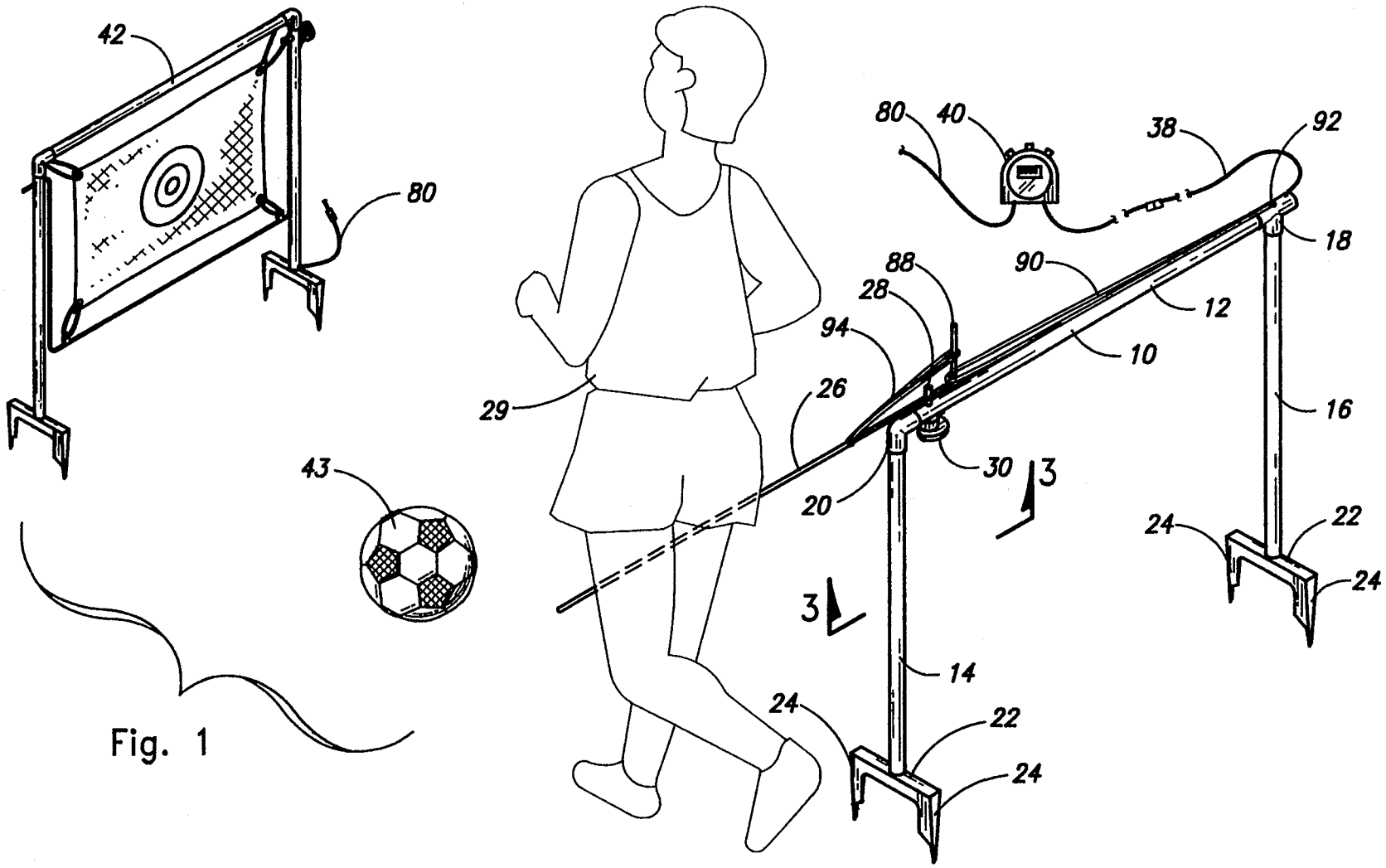
FIG. 1 is a perspective view of one embodiment of the present invention showing, in the foreground, a wand or lever being activated by a human being to start a timer and, in the background, a target, such as might be encountered by a soccer ball, to stop the timer; in this Figure the soccer target appears to be considerably closer to the human being than would actually be the case.

FIG. 1 shows a horizontal device or turnstile 10 which consists of a horizontal bar or pipe 12 connected to a pair of vertical pipes 14 and 16 by any convenient hardware. As shown in this Figure, the upper end of the pipe 16 connects with the pipe 12 by means of a Tee connection 18. The upper end of the vertical pipe 14 connects with the horizontal pipe 12 by means of an elbow 20. The lower end of each vertical pipe connects with the horizontal foot 22 from which depend a pair of vertical spikes 24. When the device 10 is set up in the ground, one merely places his foot on each foot 22 to impale the spikes 24 into the ground.

Figure 3:
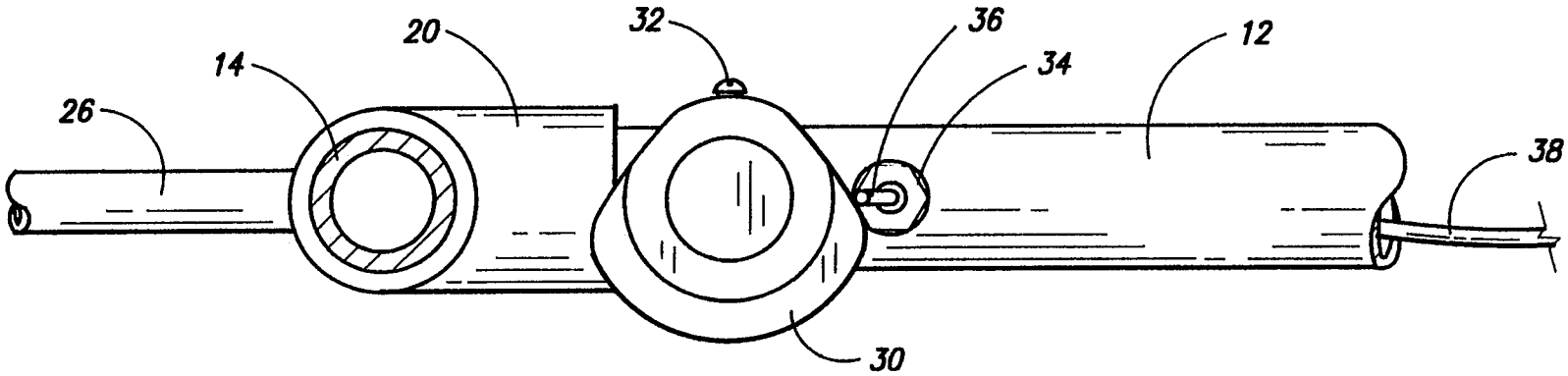
FIG. 3 is a sectional view taken along section line 3—3 of FIG. 1 showing details of the cam and microswitch on the turnstile.
Figure 4:
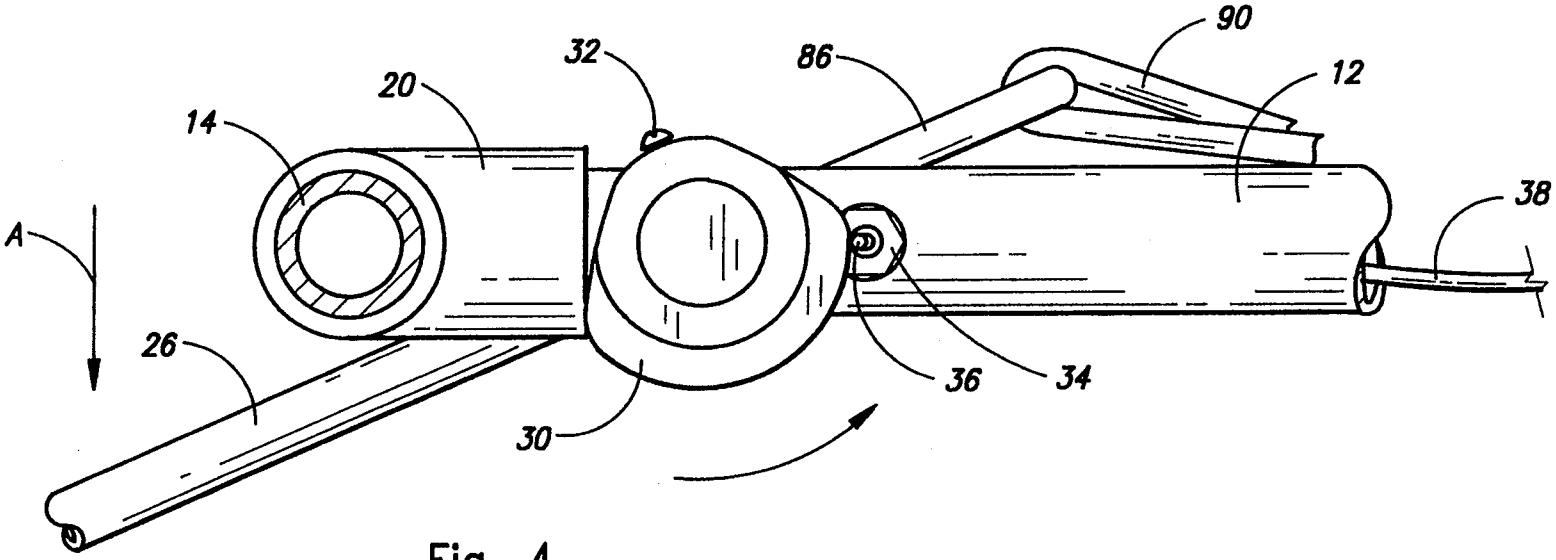
FIG. 4 is a view similar to FIG. 3, but showing movement of the lever and cam in response to the movement of a human being past the turnstile.

A horizontal rod or lever 26 is connected at its inner or right-hand end to a rotatable shaft 28 in a manner later to be described. The rod 26 is hollow and preferably made of fiberglass. The rod 25 can also be referred to as a wand. The other end of the wand 26 extends outwardly so as to be engaged by a human being 29 who would actuate the device 10 in the same manner as one walking through a turnstile. The shaft 28 is suitably mounted for rotation in the horizontal pipe 12. An arcuate cam 30 (see also FIGS. 3 and 4) is connected to the lower end of the shaft 28 and is affixed thereto by means of a set screw 32. A microswitch 34 having a toggle arm 36 is mounted on the underside of the pipe 12. As shown in FIG. 3, the outer surface of the cam 30 is barely touching the toggle arm 36; however, as the lever 26 moves in the direction of the arrow A in response to the movement of the person 29 in FIG. 1 past the turnstile 10, the outer surface of the cam 30 will move the toggle arm 36 to actuate the microswitch 34, as shown in FIG. 4. An electrical lead 38, which passes through the center of the pipe 12 and connects with the microswitch 34, also connects with a timer 40, shown in FIG. 1. The actuation of the microswitch 34 as shown in FIG. 4 will start the timer 40.

Figure 2:
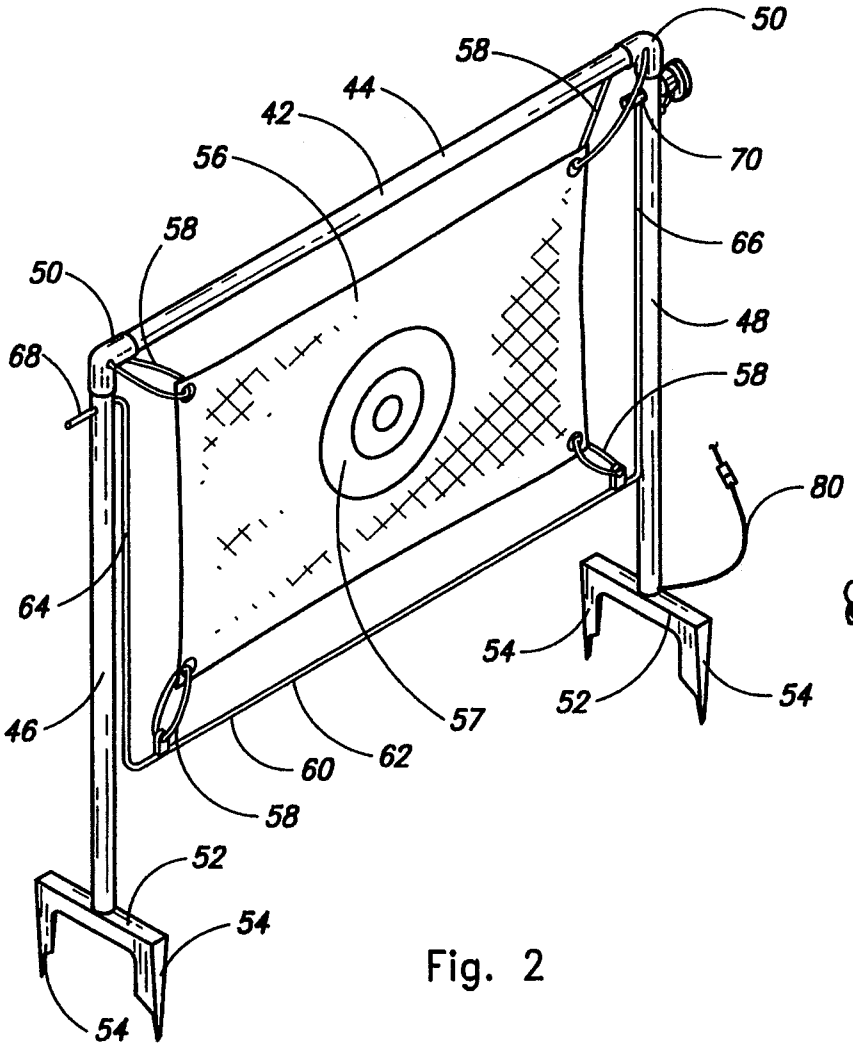
FIG. 2 is a perspective view, on an enlarged scale, of the soccer target shown in FIG. 1.

For the purpose of illustration only, the target 42 shown in FIG. 2 and in the background of FIG. 1 represents a "soccer" target. Obviously, this target could be used for baseball, frisbee, football, etc. Thus, the person 29, on passing the turnstile 10, as shown in FIG. 1, would look for a soccer ball 43, for example, to kick in the direction of the target 42. The target 42 includes a horizontal pipe 44 and a pair of vertical pipes 46 and 48 connected to the ends of the pipe 44 by means of elbows 50. The lower ends of the pipes 46 and 48 connect with horizontal feet 52 from which depend vertical spikes 54. Thus, the target 42 can be impaled into the ground in the same manner as the turnstile 10. A rectangular sheet of fabric 56 is supported from the target 42. The upper corners of the fabric sheet 56 are connected to the target 42 by means of loops 58 which pass through suitable holes (reinforced) in the upper corners of the fabric sheet 56 and through holes in the elbows 50. A bullseye 57 is attached to the center of the fabric sheet 56 for possible use in other games or sports such as archery, baseball throwing, frisbee throwing and the like.

Figure 6:
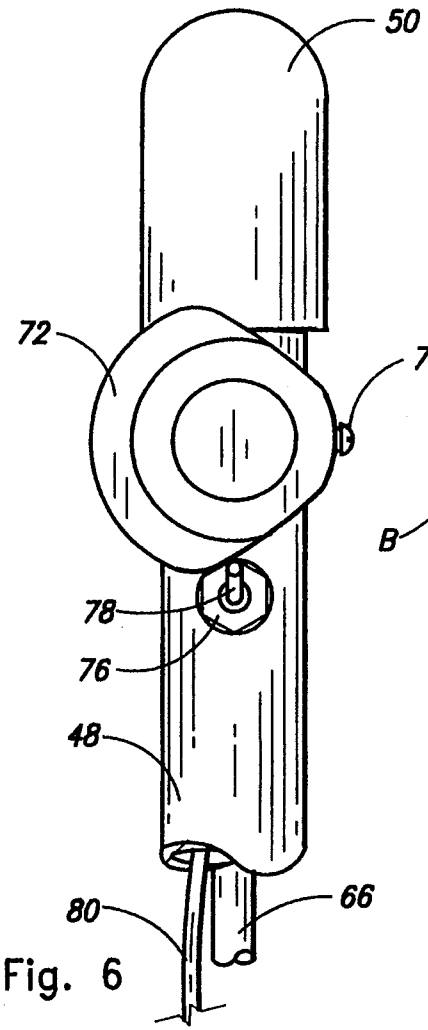
FIG. 6 is a right-hand side view taken from FIG. 5.
Figure 5:
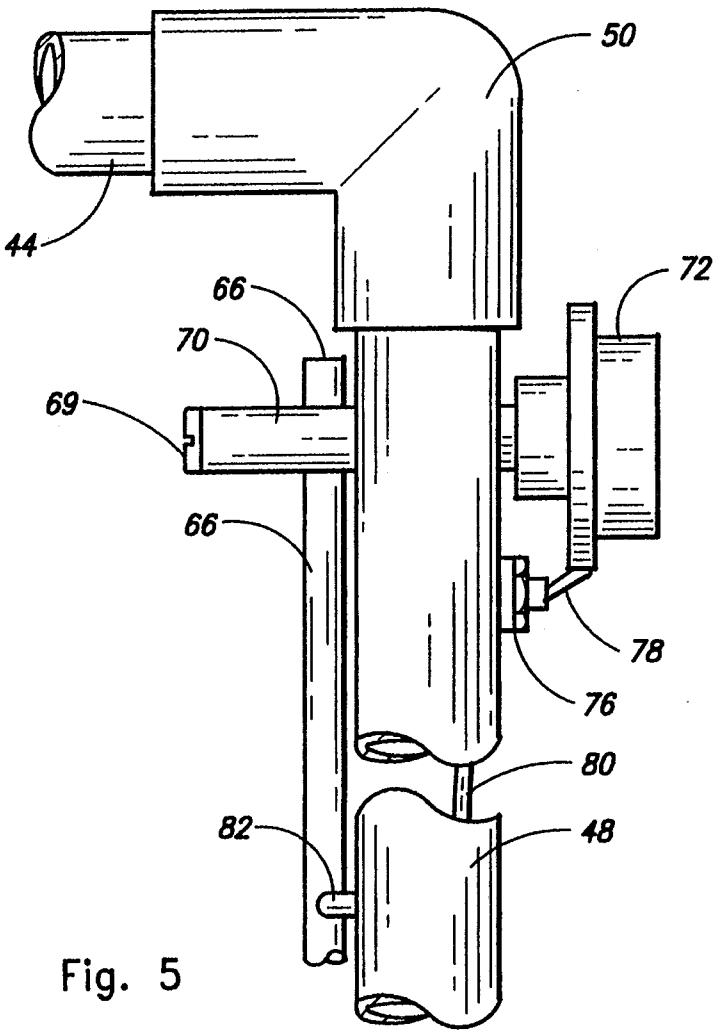
FIG. 5 is a fragmentary view, on an enlarged scale, of the structure shown in the upper right-hand portion of FIG. 2.

A U-shaped wire or rod 60 is supported from the target member 42 as follows: the U-shaped rod 60 is composed of a lower horizontal member 62 and a pair of vertical portions 64 and 66 which are connected at their lower ends to the horizontal member 62 by right-angled bends as shown and which extend upwardly adjacent and inboard of the pipes 46 and 48, respectively. The upper end of the vertical rod 64 is provided with a horizontal portion 68 which extends outwardly through a hole extending through the pipe 46 adjacent the end thereof. The rod 64 is thus pivotal with respect to the pipe 46 by virtue of the horizontal end 68. The upper end of the rod 66 is connected to a horizontal shaft 70 which is the equivalent of the vertical shaft 28 shown in FIG. 1 and as best shown in FIG. 5. For purpose of adjustment, the upper end of the rod 66 extends through a hole (not shown) in the shaft 70 and above the shaft as shown in FIG. 5. A set screw 69 is received within the shaft 70 and is adapted to bear against the upper end of the rod 66 to permit adjustment of the upper end of this rod. The horizontal shaft 70 is journaled for rotation in the upper end of the pipe 48. As shown in FIG. 5, the right-hand end of the shaft 70 extends through the pipe 48 and connects with a rotary cam 72 which is essentially the same as the cam 30 shown in FIGS. 1, 3 and 4. The cam 72 is keyed to the shaft 70 by means of a set screw 74. A microswitch 76 having a toggle arm 78 is mounted on the pipe such that the toggle arm 78 is adjacent the outer surface of the cam 72, as best shown in FIG. 6. However, if a soccer ball 43 or other ball (not shown) were kicked (or thrown) by the person 29 against the fabric sheet 56, the U-shaped frame 60 would pivot and the cam 72 would turn in the direction shown by the arrow B in FIG. 7.

Figure 7:
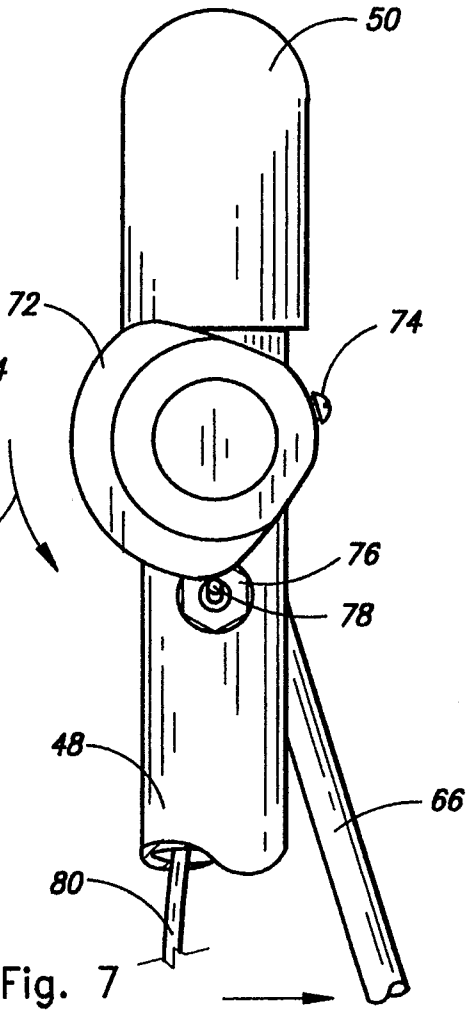
FIG. 7 is a view similar to FIG. 6 showing actuation of the microswitch when the target has been impacted.

In the FIG. 7 position, the cam 72 has moved the toggle arm 78 sufficiently so as to actuate the microswitch 76. An electric lead 80 is located within the vertical pipe 48 and connects at its upper end with the microswitch 76. As best shown in FIG. 2, the lead 80 is located within the vertical pipe 48 and connects at its upper end with the microswitch 76. As best shown in FIG. 2, the lead 80 extends externally from the pipe 48 and is adapted to connect with the timer 40 as shown in FIG. 1. Thus, when the target 42 is activated by movement of the U-shaped rod 60 in response to an impact received in the fabric sheet 56, the microswitch 76 will be actuated to turn off the timer 40. After the U-shaped rod 60 rotates rearwardly in response to the aforementioned impact, the rod 60 and fabric sheet 56 will move forwardly under the force of gravity; however, a pin 82, which projects inboard from the pipe 48, constitutes a stop for the vertical leg 66 of the U-shaped member 60 to prevent further forward movement of this member 60.

Figure 8:
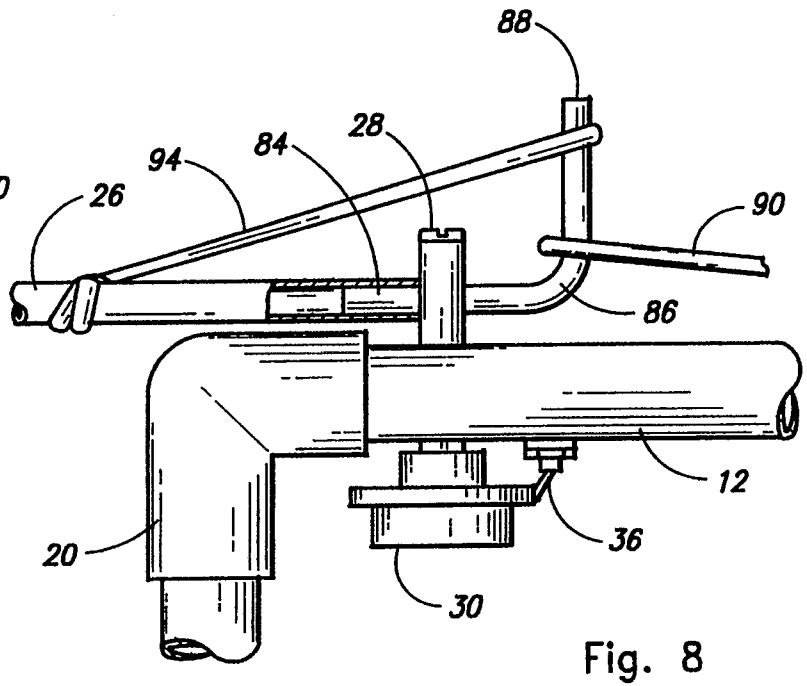
FIG. 8 is a fragmentary elevation, partly in section, of the upper left-hand end of the turnstile showing details of how the rod is connected to the cam shaft.

Referring now to FIG. 8, the hollow fiberglass wand 26 is received, at its right-hand end, over a horizontally projecting leg 84 of an L-shaped rod 86 which projects through a hole (not shown) in the upper end of the shaft 28 and is secured thereto by a set screw (not shown). The L-shaped rod 86 has a vertical leg 88 which is employed to return the L-shaped member 86 and hence, the rod 26 into horizontal alignment with the pipe 42 after the person 29 passes through the turnstile 10. For this purpose, a bungee cord 90 has one end encircling the leg 88 and the other end connects to the Tee 18 at 92. For the purpose of holding the right-hand end of the wand 26 on the horizontal leg 84, a rubber band 94 is attached to the rod 26 adjacent the right-hand end thereof. The other end of the rubber band encircles the upper end of the vertical leg 88.

Comparing the turnstile 10 of FIG. 1 with the details of FIG. 8, the hollow rod 26 and the L-shaped rod 86 together constitute a lever which rotates the shaft 28; the majority of the above described lever extends to the left as principally constituted by the hollow rod 26, with a short portion of this lever extending to the right as constituted by the portion of the L-shaped lever 86 which extends from the shaft 28 to the vertical leg 88. The above described lever, therefore, is turned in a clockwise direction when the person 29 moves against and beyond the hollow rod 26; the bungee cord 90, being connected to the right-hand end of the turnstile 10 and encircling the vertical leg 88, constitutes a resilient return of the above described lever in a counter-clockwise direction to the initial position shown in FIG. 1.

Figure 9:
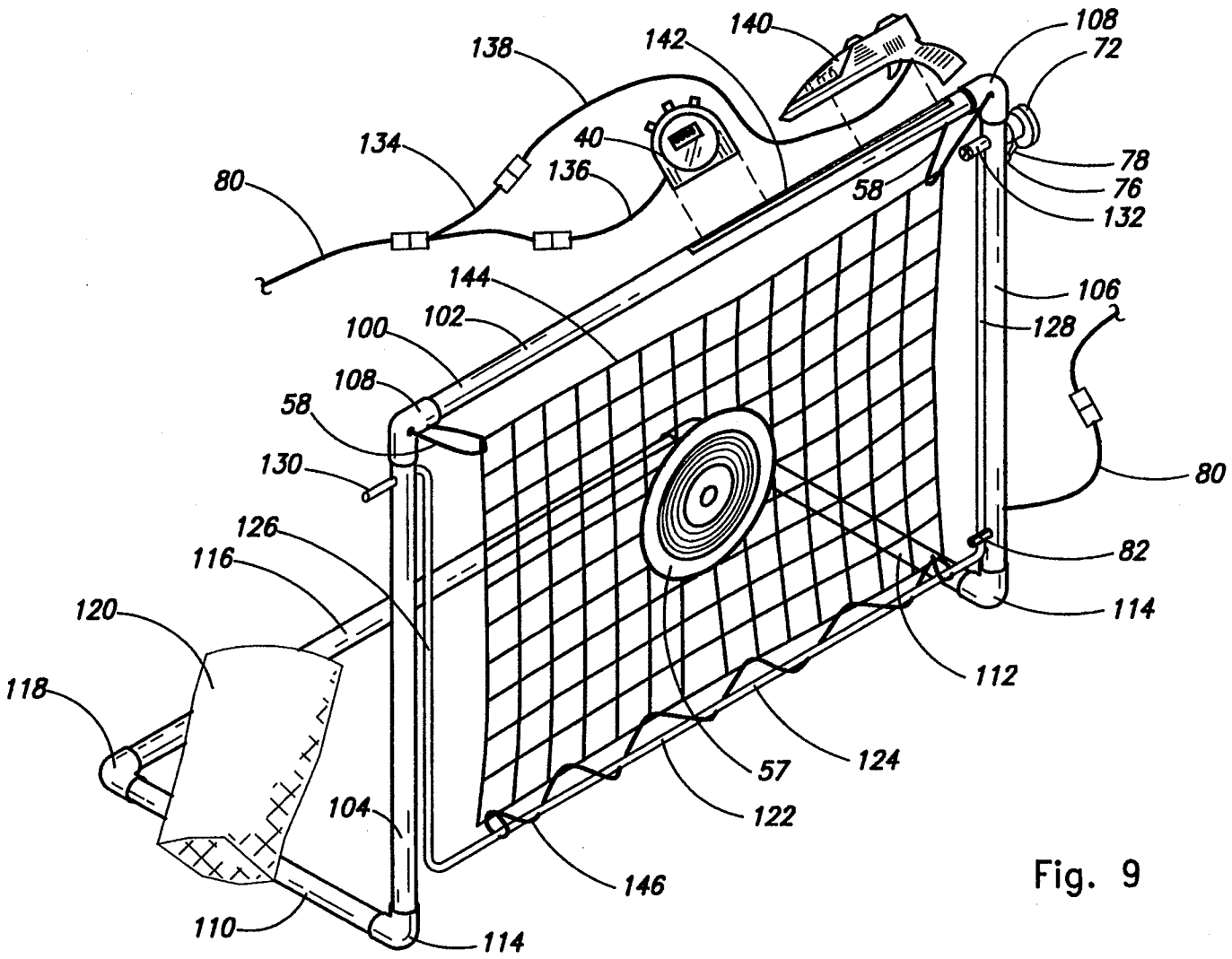
FIG. 9 is a perspective view, on an enlarged scale, of a modified form of soccer target as compared to FIG. 2.

FIG. 9 shows a target 100 which is designed as a target for use in connection with soccer. This target is similar to the target which is shown in FIG. 2, but differs somewhat as would appear from the following description. The target 100 includes a horizontal pipe 102 and a pair of vertical pipes 104 and 106 which connect, at their upper ends, to the pipe 102 by means of elbows 108. The lower ends of the pipes 104 and 106 connect with a pair of shorter horizontal pipes 110 and 112 by means of elbows 114. The pipes 110 and 112 connect at their rear ends to an elongated horizontal pipe 116 by means of elbows 118. The pipes 110, 112 and 116 are adapted to lie against the ground such that sandbags 120 (only one of which is shown in FIG. 9) can be placed over the corners of the horizontal frame as shown to prevent the target 100 from tipping when it is hit by a soccer ball under extreme force.

A U-shaped wire or rod 122 is supported from the target member 100 as follows: the U-shaped rod 122 is composed of a lower horizontal member 124 and a pair of vertical portions 126 and 128 which are connected at their lower ends to the horizontal member 124 by right-angled bends as shown and which extend upwardly adjacent and inboard from the pipes 104 and 106 respectively. The upper end of the vertical rod 126 is provided with a horizontal portion 130 which extends outwardly through a hole extending through the pipe 104 adjacent the upper end thereof. The rod 126 is thus pivotal with respect to the pipe 104 by virtue of the horizontal end 130. The upper end of the rod 128 is connected to a horizontal shaft which is the equivalent of the horizontal shaft 70 shown in FIG. 2. The shaft 132 extends to the right of the pipe 106 and connects with a cam 72 which is essentially the same as that described in connection with FIGS. 2 and FIGS. 5 through 7.

A microswitch 76 having a toggle arm 78 is mounted on the vertical pipe 106 in the same fashion that microswitch 76 is mounted on the pipe 48, as previously described. A pin 82 is mounted on the pipe 106 and constitutes a stop for the vertical leg 128 in the same manner as described previously in connection with the pin 82 attached to the vertical pipe 48. Thus, the pin 82 in FIG. 9 will prevent forward movement of the U-shaped member 122. As was the case in connection with FIG. 1, the target 100 is provided with an electrical lead 80 which connects with the microswitch 76 and which also connects with a timer 40. In the case of FIG. 9, the lead 80 connects to the timer 40 through a "Y" connector 134. One of the leads 136 of the "Y" connector connects with a timer 40, and the other lead 38 connects to a suitable alarm 140 which is shown in the form of a gun. The device 140 is capable of producing an audible alarm whenever the timer is actuated. Purely for the purpose of convenience, a hook and loop fastener ("Velcro" ®) strip 142 is attached to the upper surface of the horizontal pipe 102 for holding the timer 40 and the alarm 140 in a known fixed location. Of course, the timer 40 and alarm 140 would also be provided with hook and loop fastener strips (not shown) which would cooperate with the strip 142 A fabric or net sheet 144 is secured to the target 100 by means of loops 58 which pass through the corners of the net 144 and through holes in the elbows. The lower edge of the net 144, including the lower corners thereof, are secured to the lower horizontal portion 124 of the U-shaped rod 122 by means of a wire 146 which is coiled around the horizontal rod 124 and the lower horizontal edge of the net 144 as shown in FIG. 9.

Figure 10:
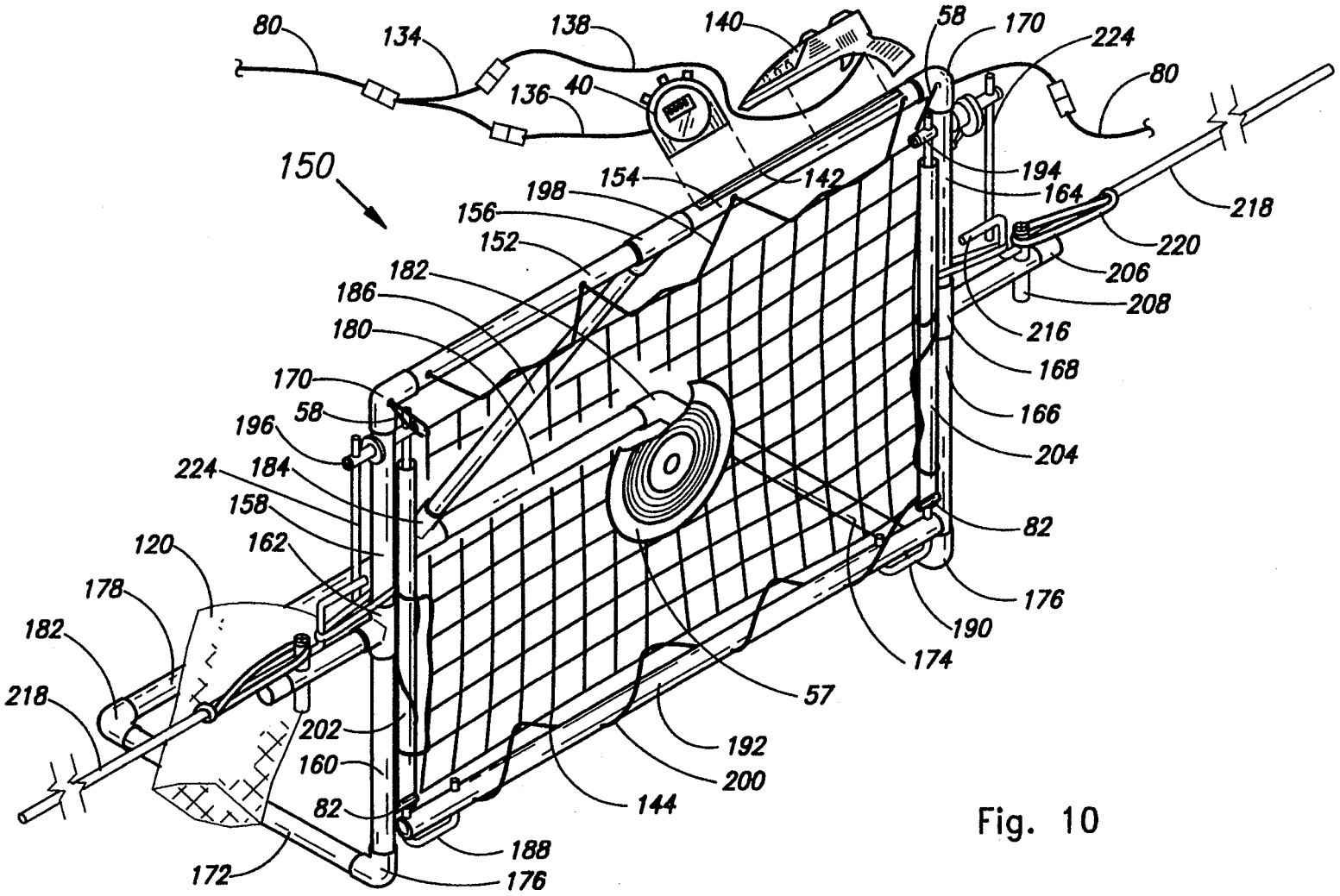
FIG. 10 is a perspective view of a modified form of the invention where a target is combined with the turnstile.

FIG. 10 shows a target 150 which is similar in many respects to the target shown in FIG. 9; however, the target 150 of FIG. 10 is somewhat larger and more rigid than the FIG. 9 embodiment. Furthermore, the embodiment of FIG. 10 combines the turnstile feature of the present invention with the target itself, as will hereinafter appear. On the target 150, the upper horizontal member is composed of two horizontal pipes 152 and 154 which are connected together by means of a Tee 156. At the left side of the target 150, two aligned vertical pipes 158 and 160 connect by means of a Tee 162. At the right-hand side of the target 150, two aligned vertical pipes 164 and 166 connect together by means of a Tee 168. The upper ends of the pipes 158 and 164 connect to the other ends of the pipes 152 and 154, respectively, by means of elbows 170. Rearwardly extending horizontal pipes 172 and 174 connect at their forward ends to the lower ends of pipes 160 and 166, respectively, by means of elbows 176. The rear ends of the horizontal pipes 172 and 174 connect at right angles to horizontal pipes 178 and 180 by means of elbows 182. The pipes 178 and 180 are connected together by means of a Tee 184. An inclined pipe 186 connects at its lower end to the Tee 184 and at its upper end to the Tee 156 so as to constitute a brace for the target 150.

The target 150 shown in FIG. 10 is provided with a U-shaped frame similar to the U-shaped frame of FIG. 9; however, the U-shaped frame of FIG. 10 is composed of several different elements. That is, the U-shaped frame of FIG. 10 is composed of two J-shaped members 188 and 190 which pass through a pair of spaced holes at each end of a horizontal pipe 192. Thus, with respect to the right-hand end of the pipe 192, the lowermost portion of the "J" extends immediately below the pipe. The short end of the "J" extends through the pipe and terminates a short distance above. The long leg of the "J" 190 extends upwardly and into and through a shaft 194. At the left-hand end of the pipe 192 the J-shaped member 188 (which is a reversed "J") is connected in similar fashion to the pipe 192. Thus, the short leg of the J-shaped member 188 extends through the pipe 192 and terminates a short distance above, whereas the long leg of the J-shaped member 188 extends upwardly and connects with a second shaft 196 which is on the opposite side of the frame structure from shaft 194.

A fabric net or mesh 144 is secured to the target 150 in a manner similar to the net 44 in FIG. 9. That is, loops 58 connect the upper corners of the net 144 to the elbows 170. In addition, a wire or cord 198 is threaded through suitable holes in the horizontal pipes 152 and 154 and also along the upper edge of the net 144, as shown. For the purpose of securing the lower edge of the net 144 to the pipe 192, a similar cord or wire 200 is wrapped around the pipe 192 and through suitable locations along the lower edge of the mesh 144. If desired, additional loops can be employed at convenient locations around the periphery of the net 144 to secure the same as needed or desired. To provide rigidity or protection of the "J" members 188 and 190, vertical pipes 202 and 204 are received around the long ends of the "J"s of members 188 and 190, respectively.

Figure 11:
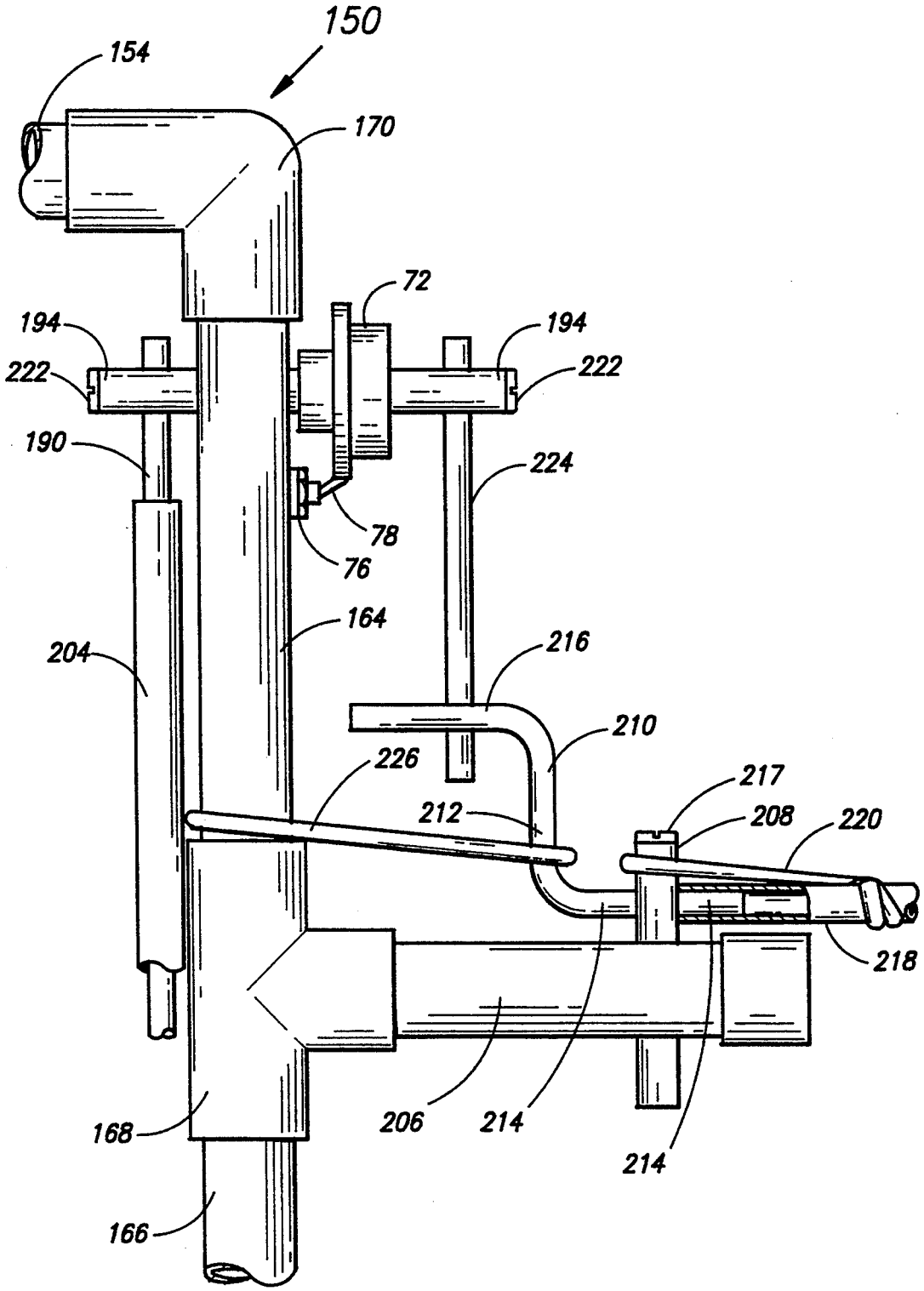
Fig. 11 is a partial front elevation on an enlarged scale and with some parts in section of the upper right-hand portion of FIG. 10.

Referring now to FIG. 11, which shows the upper right-hand end of the target 150 shown in FIG. 10, a horizontal pipe 206 extends outwardly from the Tee 168 essentially in the plane of the target 150. A rotatable shaft 208 is mounted for rotation on the pipe 206. A bent rod 210 has a central vertical portion 212, a lower horizontal portion 214 and an upper horizontal portion 216. The lower horizontal portion 214 is received in a suitable hole (not shown) in the shaft 208 and extends to the right of the shaft 208, as shown in FIG. 11. A set screw 217 which extends down through the shaft 208 will hold the rod 214 in the position shown in FIG. 11. A hollow fiberglass wand 218 is received over the right-hand end of the rod 210 adjacent the shaft 208. The hollow fiberglass wand 218 is similar to the fiberglass wand shown in FIGS. 1 and 8 and constitutes the immediate operative element of a turnstile. For the purpose of holding the left-hand end of the wand 218 on the right-hand end of the horizontal leg 214, a rubber band 220 is attached to the wand 218 adjacent the left-hand end thereof and the other end of the rubber band encircles the upper end of the shaft 208.

The upper end of the J-shaped member 190 extends through and above the shaft 194. A set screw 222, which extends coaxially within the shaft 194, bears against the upper end of the rod 190 and holds it in the position shown in FIG. 11. It should be understood that the upper end of the J-shaped rod 188 is similarly secured to the shaft 196 by means of a set screw 222. The loosening or tightening of the set screw 222 will permit lowering or raising the assembly constituted by the J-shaped members 188 and 190, the horizontal pipe 192 and the net 144.

The shaft 194 extends through the pipe 164 and to the right thereof where it is secured to a cam 72. The cam 72 rotates when the shaft 194 rotates as a result of the pivoting of the J-shaped member 190 when a ball or missile hits the net 144. A microswitch 76, which is identical to the microswitch 76 previously described, is mounted on the pipe 164 in such a manner that the toggle arm 78 of the microswitch can be actuated by the turning of the cam 72 to start or stop the timer 40 in the manner previously described. The shaft 194 extends further to the right beyond the cam 72, as shown in FIG. 11, and a short vertical rod 224 passes through a suitable hole in the right-hand end of the shaft 194. A set screw 222, which is mounted coaxially within the right-hand end of the shaft 194, is used to secure the upper end of the vertical rod 224 in the position shown. If desired, the set screw 222 can be loosened to adjust the position of the rod 224. The lower end of the rod 224 extends below and behind the horizontal rod 216. Thus, if a person, such as the person 29, were to approach the target from the rear at the right side thereof as shown in FIG. 10, he would pass against the wand 218 to pivot the same in a clockwise direction so as to rotate the shaft 208. Rotation of the shaft 208 in a clockwise direction will cause the horizontal arm 216 to move against the vertical arm 224 to move the same rearwardly. This action is similar to hitting the mesh 144 with a missile. Rearward movement of the vertical rod 224 will cause the cam 72 to actuate the microswitch 76 and send a signal to the timer 40 and/or audible alarm 140. After the person passes through and beyond the wand 218, a rubber band 226 will cause the wand 218 and the bent rod 212 to return to the position shown in FIG. 11; one end of the rubber band encircles the vertical leg 212 of the member 210 and the other end of the rubber band encircles the pipe 164.

Whereas the above description and illustration of FIG. 11 applies to the upper right-hand portion of FIG. 10, it should be noted that the upper left-hand portion of FIG. 10 is similarly provided with a wand 218 which is operated in the same manner and with the same elements as shown in the right portion of FIG. 10 with one exception: that is, the shaft 196, which is journaled for rotation in the upper end of the vertical pipe 158, does not operate a cam 72 because the cam 72 which is operated by the shaft 194 is adequate. Briefly, the upper end of the J-shaped member 188 rotates with the shaft 196 and arm 224 extends downwardly from the shaft 196 on the right. The remainder of the elements are also shown (but not numbered) on the left side of FIG. 10 such that a person 29 approaching from the rear at the left of the target 150 can contact the left wand 218 and rotate the same in a forward direction, the left wand 218 will cause the left vertical arm 228 to pivot rearwardly. The entire swinging target consisting of the J-members 188 and 190, the pipe 192 and the mesh net 144 will pivot rearwardly and the right-hand shaft 194 will also turn to actuate the microswitch 76.

Thus, the structure shown in FIG. 10 constitutes a combination target and turnstile; in fact, a combination target with two turnstiles.

If the operation of either turnstile to the right or left of the target 150 of FIG. 10 is used to initiate the timer 40, the person 29 can thereafter kick or throw a missile against the net 144 to cause the target assembly to pivot rearwardly and actuate the microswitch 76 for a second time to stop the timer 40 and actuate the alarm 140. The elapsed time in the timer 40 will indicate how long it took the person to pass through the turnstile and make his "score". The pipe 192 is sufficiently close to the ground that the target 150 can be used for hockey. Of course, if desired, the entire target assembly consisting of the J-shaped members 188 and 190, pipe 192 and mesh 144 can be raised or lowered by adjusting the appropriate set screws 222 to accommodate for differences in the length of grass on the field where the target 150 is situated. Again, sandbags 120 (only one of which is shown in FIG. 10) can be used to add stability to the target 150. A pin 182 is also mounted on the pipe 166 to prevent further forward movement of the target assembly. It should be further noted that actuation of the target 150 by hitting the same following the initiation of the timer by the turnstile 218 will return the elements to the position shown in FIG. 10, thereby "resetting" the turnstiles.

The target 150 shown in FIG. 10 can be provided without the turnstiles 218 by simply removing the pipe 206 and its associated elements together with the vertical rod 224.

The turnstile shown in FIGS. 1, 3 and 4 can be used with the targets shown in FIG. 2, 9 and 10 or two turnstiles such as shown in FIGS. 1, 3 and 4 can be used for running, skiing, skating, etc., where the first turnstile would be used to start the timer 40 and the second turnstile, which would be located at a predetermined distance from the first turnstile, would be used to stop the timer.

Figure 12:
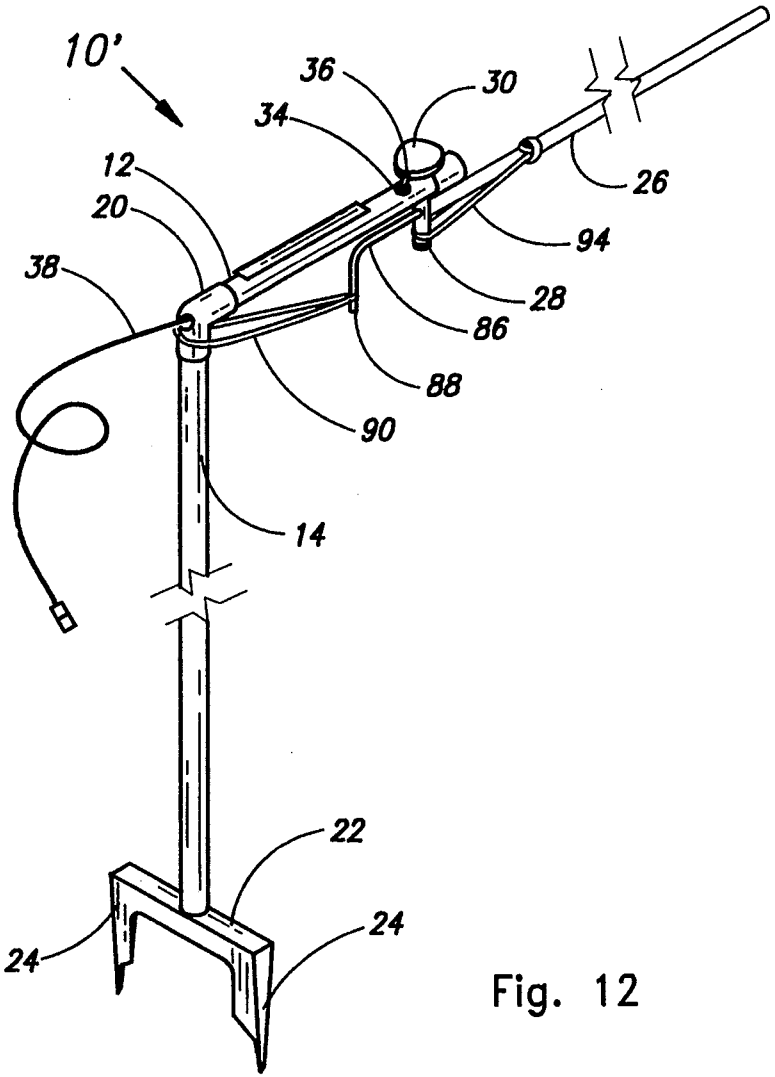
FIG. 12 is a perspective view of a preferred and simplified embodiment of the present invention showing a wand or lever supported by a single vertical pipe.

Referring now to FIG. 12, this figure shows a turnstile 10' which consists of a horizontal bar or pipe 12 connected to a single vertical pipe 14 by any convenient hardware such as an elbow 20. The lower end of the vertical pipe 14 connects with a horizontal foot 22 from which depend a pair of vertical spikes 24. When the device 10' is set up in the ground, one merely places his foot on the horizontal foot 22 to impale the spikes in the ground.

A horizontal rod or lever 26 is connected at its inner end to a rotatable shaft 28 in a manner later to be described. The rod 26, which can be referred to as a wand, is hollow and preferably made of fiberglass. The outer end of the wand 26 extends away from the turnstile so as to be engaged by a human being 29 (as in FIG. 1) who would actuate the device 10' in the same manner as one walking through a turnstile. The vertical pipe 14 is shown in broken lines to represent a pipe of variable length. For example, where the turnstile was intended to be actuated by a human being 29, the pipe 14 would be of sufficient length that the wand 26 would be essentially waist high. The pipe 14 can also be merely several inches in vertical height so that the horizontal wand 26 would be low to the ground for actuation by a radio controlled car, for example.

Figure 13:
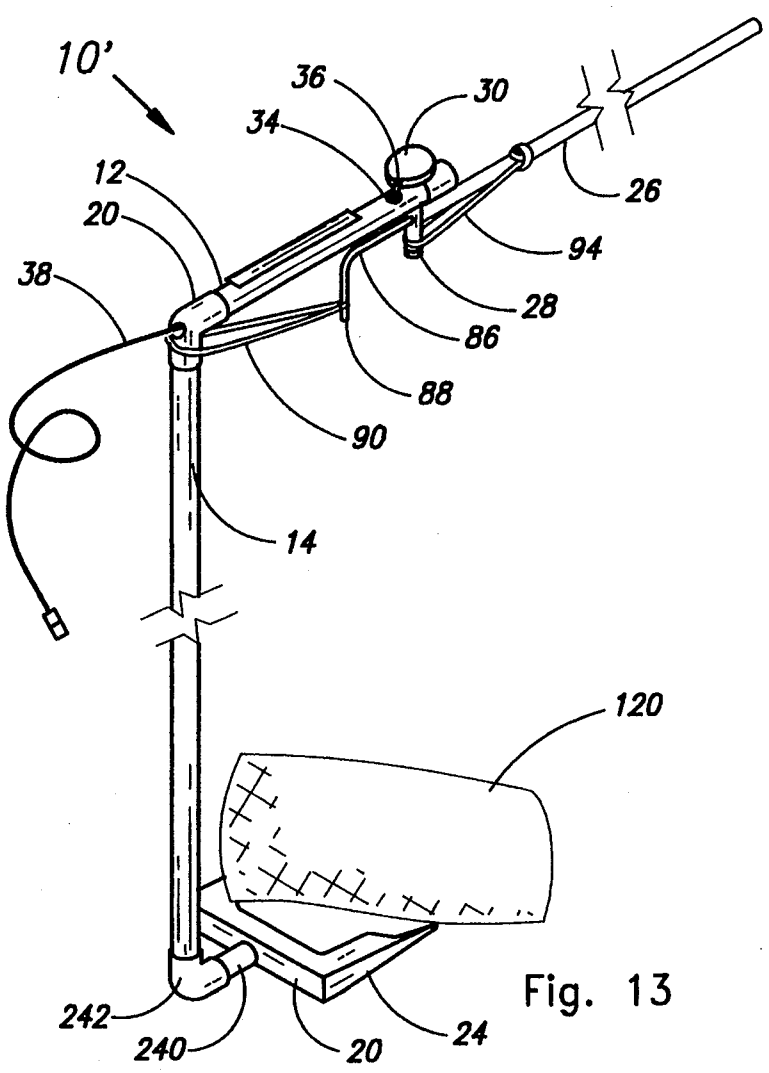
FIG. 13 is a perspective view similar to FIG. 12 wherein the vertical pipe is held in place by means of a sandbag.

An arcuate cam 30 is connected to the upper end of the shaft 28 and is affixed thereto by means of a set screw 32 (see FIGS. 3 and 4). A microswitch 34 having a toggle arm 36 is mounted on the pipe 12 adjacent the cam 30. At this juncture it should be pointed out that the embodiment of FIGS. 12 and 13, as far as the cam and microswitch are concerned, differs principally from the embodiment of FIG. 1 in that the cam of FIGS. 12 and 13 is mounted on the upper end of the shaft 28 whereas, in FIG. 1 and FIGS. 3, 4 and 8, the cam 30 is mounted on the lower end of the shaft 28. Similar considerations hold true for the microswitch 34 which is mounted on the upper side of the vertical pipe 12 in FIGS. 12 and 13, whereas it is mounted on the underside of the pipe 12 on FIGS. 1, 3 and 4. For further details of the cam and the wand shown in FIGS. 12 and 13, reference should be made to FIGS. 3 and 4 with the understanding that position of the cam and the wand 26 are reversed as explained above. As previously explained in relation to the prior description of FIG. 3, the outer surface of the cam 30 in FIG. 12 is barely touching the toggle arm 36; however, as the lever 26 moves in a counterclockwise direction in response to the movement of an object through the turnstile, the outer surface of the cam 30 will move the toggle arm 36 to actuate the microswitch 34. An electrical lead 38, which passes through the center of the pipe 12 and out through the elbow 20, connects with the microswitch 34 and also connects with a timer 40 (shown in FIG. 1). Thus, the actuation of the microswitch 34 in FIG. 12 will start the timer 40.

The left-hand end of the fiberglass wand 26 is received over a horizontally projecting leg 84 of an L-shaped rod 86 which projects through a hole (not shown) in the lower end of the shaft 28 and is secured thereto by a set screw (not shown). The L-shaped rod 86 has a vertical leg 88 which is employed to return the L-shaped member 86 and, hence, the wand 26 into horizontal alignment with the pipe 12 after a person or object passes through the turnstile 10'. For this purpose, a bungee cord 90 has one end encircling the leg 88 and the other end goes around the lower portion of the elbow 20. In order to hold the left-hand end of the wand 26 on the horizontal leg 84, a rubber band 94 is attached to the wand 26 adjacent the left-hand end thereof. The other end of the rubber band encircles the lower end of the shaft 28.

Referring now to FIG. 13, this figure differs from FIG. 12 only in the manner in which the vertical pipe 14 is supported in relation to the ground. Previously, we have described the foot 22 and the prongs 24 in relation to impaling the latter in the ground. In the alternative embodiment shown in FIG. 13, the horizontal foot 20 is attached to a short horizontal pipe 240 which connects at right angles to the lower end of the vertical pipe 14 by means of elbow 242. Also in the case of FIG. 13, the spikes 24 extend out horizontally so as to provide a bed for supporting thereon a sand bag 120. Thus, the embodiment of FIG. 13 can be more readily moved from place to place, whereas the embodiment of FIG. 12 will have to be pulled up out of the ground and re-impaled at another desired location.

Figures 14, 15:
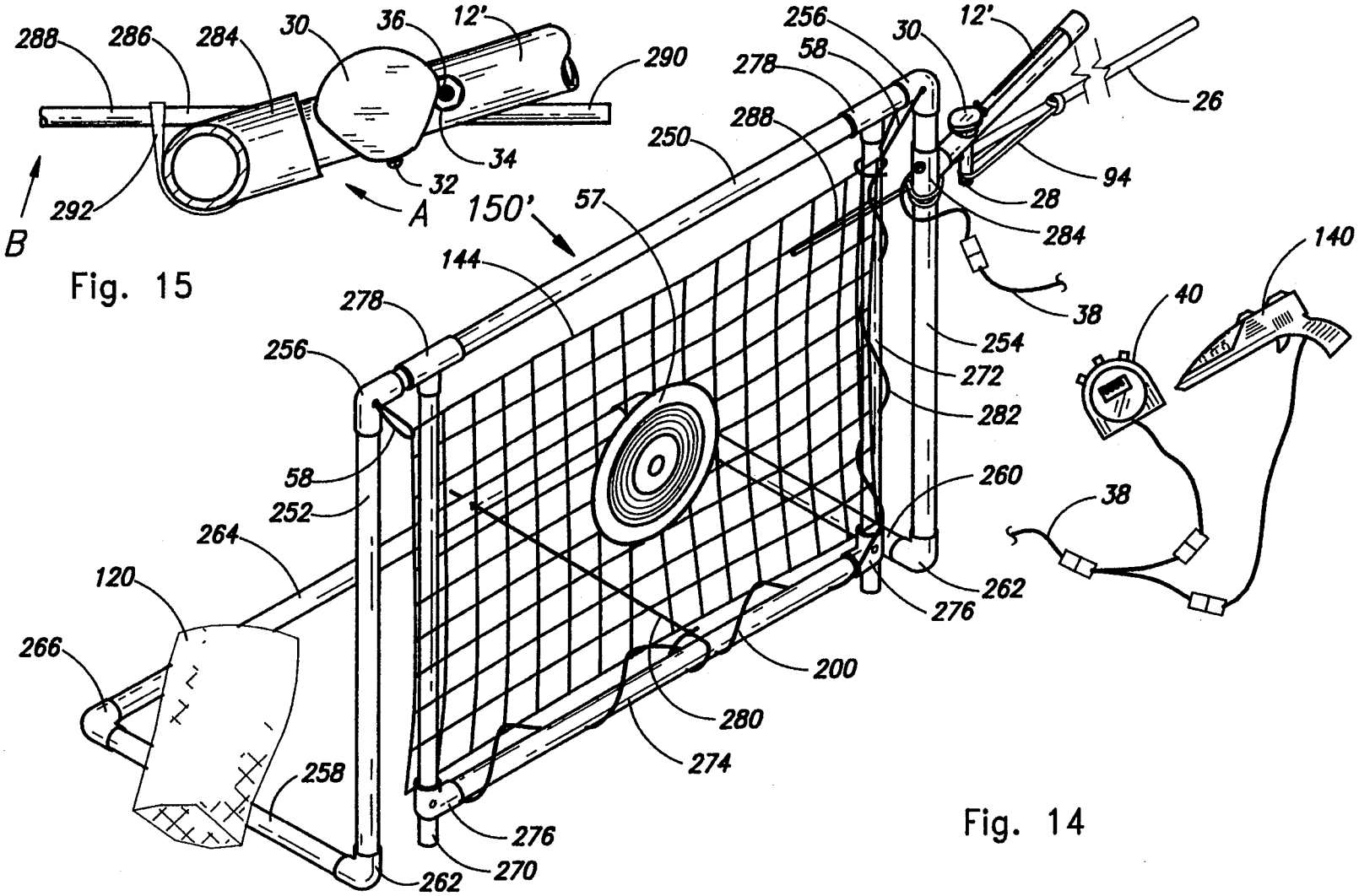
Figure 14 is a view similar to FIG. 10, but showing numerous improvements and/or simplifications.
FIG. 15 is a fragmentary plan view, with one part in section, of the horizontal arm and lever located at the right-hand side of FIG. 14.

FIG. 14 shows a target 150' which is similar in many respects to the target 150 shown in FIG. 10; however, the target 150' of FIG. 14 is considerably simpler than the target and associated turnstile illustrated in FIG. 10. The target 150' includes a horizontal pipe 250 and a pair of vertical pipes 252 and 254 which connect, at their upper ends, to the pipe 250 by means of elbows 256. The lower ends of the pipes 252 and 254 connect with a pair of shorter horizontal pipes 258 and 260 by means of elbows 262.

The pipes 258 and 260 connect at their rear ends to an elongated horizontal pipe 264 by means of elbows 266. The pipes 258, 260 and 264 are adapted to lie against the ground such that sandbags 120 (only one of which is shown in FIG. 14) can be placed over the corners of the horizontal frame as shown to prevent the target 150' from tipping when it is hit by a soccer ball under extreme force.

The target 150' shown in FIG. 10 is provided with a U-shaped frame similar to the U-shaped frame shown in FIGS. 9 and 10; however, the U-shaped frame of target 150' is composed of two vertical pipes 270 and 272 which are attached at their lower ends to a horizontal pipe 274 by means of connectors 276. The upper ends of the pipes 270 and 272 connect with T-shaped members 278 which have an inner horizontal opening slightly larger than the outer diameter of the horizontal pipe 250. Thus, the frame consisting of vertical pipes 270 and 272 and horizontal pipe 274 will pivot with respect to the pipe 250 around the Tee connections 278. A rope 280 is connected to the center of the pipe 274 and to the center of the pipe 264 to prevent forward movement of the U-shaped member from the position shown in FIG. 14.

A fabric net or mesh 144 is secured to the target 150' in a manner similar to the net 144 in FIG. 10. That is, loops 58 connect the upper corners of the net 144 to the elbows 256. A wire or cord 200 is wrapped around the pipe 274 and through suitable locations along the lower edge of the mesh 144. A similar cord or wire 282 is wrapped around the vertical pipe 272 and through suitable locations along the side edge of the mesh 144. The bullseye 57 is mounted centrally with respect to the mesh 144. The pipe 252 is provided with a Tee 284 which is mounted on or integral with the pipe 254 adjacent the top thereof and spaced downwardly below the horizontal pipe 250. The Tee 284, as best shown in FIG. 15, is tilted at a slight acute angle rearwardly with respect to the plane of the U-shaped member described.

A horizontal pipe 12' is received in the horizontal opening of the Tee 284 and also extends rearwardly at a slight angle with respect to the plane of the U-shaped member. A vertical shaft 28 is rotatably mounted in the horizontal pipe 12'. A horizontal lever or wand 26 (previously described) is connected at its inner or left-hand end to the rotatable shaft 28 in a manner later to be described. The other (right-hand) end of the wand 26 extends outwardly so as to be engaged by a human being 29 who would actuate the target device in the same manner as one walking through a turnstile; however, in the present case (as was the case with FIG. 10) the person would be walking from the rear of the target 150 so as to pivot or turn the wand 26 in a clockwise direction. An arcuate cam 30 (previously described) is connected to the upper end of the shaft 28 and is affixed thereto by means of a set screw 32 (see FIG. 15). A microswitch 34 having a toggle arm 36 is mounted on the pipe 12' as best shown in FIG. 15. The outer surface of the cam 30 is barely touching the toggle arm; however, as the lever 26 moves in a clockwise direction, as shown by the arrow A on FIG. 15, in response to movement of a person 29 moving from the rear of the target 150 and towards the front, the outer surface of the cam 30 will move the toggle arm 36 to actuate the microswitch 34. An electrical lead 38, which passes through the center of the pipe 12' and through the Tee connection 284, connects with the microswitch 34 and also connects with a timer 40.

A horizontal rod 286 passes through a hole (not shown) in the lower end of the shaft 28 below the pipe 12'. This rod has a left-hand end 288 which is positioned behind the U-shaped swinging member as shown in FIG. 14. The U-shaped swinging member is defined by the structure including the vertical pipes 270 and 272, the horizontal pipe 274 and the Tees 278 which permit the foregoing elements to swing around the pipe 250. Also, of course, the U-shaped member includes the mesh 144 which receives the impact from the soccer ball or other game piece to pivot the U-shaped structure towards the rear of the target member 150'.

The right-hand end 290 of the rod 286 is adapted to receive the left-hand end of the lever or wand 26 in much the same manner that the wand or lever 26 is received over the end 184 of the lever 186 shown in FIG. 8; or similar to the manner in which the left-hand end of the hollow member 218 is received over the end 214 of the rod 212 as shown in FIG. 11.

Assuming that a person 29 has walked from the rear of the target 150', has passed through and beyond the lever 26, the timer 40 is now indicating a passage of time. It is necessary, therefore, for some action to occur to stop the game. Again, assuming that the target of FIG. 15 is used in connection with a soccer game, when a person now kicks a soccer ball against the mesh 144, the U-shaped swinging structure described above will swing to the rear and move against end 288 of the rod 286 in the direction of the arrow B shown in FIG. 15, this action will cause the microswitch 30 to move again in a counter-clockwise direction as shown by the arrow A in FIG. 15 to bear against the toggle arm 36 of the microswitch 34 so as to actuate the microswitch 34 a second time and to send a signal to the timer 40 to stop the same. Thus, looking at the timer at this moment will indicate the total elapsed time between the walking through the wand 26 and the scoring of the soccer "goal".

In connection with the operation of the targets shown in FIGS. 10 and 14 it is necessary that the game be initiated by a person walking from the rear towards the front because of the fact that the stopping of the game occurs when the U-shaped pivotal member moves towards the rear. However, in connection with the turnstile of FIGS. 1, 12 and 13, these turnstiles could be adjusted and/or utilized for walking in either direction. That is, FIG. 1 suggests that the initiation of the game occurs when the person 29 walks from the foreground towards the rear. Obviously, because the cam 30 is a two-lobed cam the game could be played in such a manner that the turnstiles of FIGS. 1, 12 and 13 could be operated equally well by a person walking from the rear towards the front.

Whereas the present invention has been disclosed in terms of the specific structure described above, it should be understood that other and further modifications, apart from those shown or suggested herein, may be made within the spirit and scope of this invention.

What is claimed is:

1. A turnstile operated game for determining the elapsed time between a starting event and an ending event comprising a turnstile composed of a horizontal member supported above the ground, a vertical shaft rotatably mounted on the horizontal member, an arcuate cam mounted on the turnstile and being responsive to the rotation of the shaft, a microswitch mounted on the turnstile adjacent the cam, the microswitch having a toggle arm adapted to be contacted by the cam to actuate the microswitch upon a predetermined rotary movement of the shaft, a horizontal lever connected to the upper end of the vertical shaft and having a first portion extending away from and beyond the horizontal member, the lever having a second portion extending on the opposite side of the shaft from the first portion thereof, resilient means connected from the second portion of the lever to the horizontal member for returning the lever to its initial position after the lever has been deflected by a person walking through and past the lever whereby, when a person walks through and past the first portion of the lever, the cam will turn to actuate the microswitch, a timer connected to the microswitch such that the timer is turned on when a person walks through and past the first portion of the lever, the walking of a person through and past the first portion of the lever constituting a starting event for the game, means responsive to the completion of an ending event to send a signal to the timer and stop the same, thereby indicating the time elapsed between the starting event and the ending event.

2. A turnstile operated game as set forth in claim 1 wherein the horizontal member is comprised of a horizontal pipe having opposite ends connected to a pair of spaced vertical pipes, the vertical pipes having lower ends for supporting the horizontal pipe in spaced relation to the ground, the vertical shaft being rotatably mounted on the horizontal pipe adjacent one end thereof and having an upper end extending above the horizontal pipe and a lower end extending below the horizontal pipe, the arcuate cam being mounted on the lower end of the vertical shaft, the microswitch being mounted on the horizontal pipe adjacent the cam.

3. A turnstile operated game as set forth in claim 2 wherein the means responsive to the completion of an ending event comprises a target including a horizontal rod having opposite ends connected to upper ends of a pair of spaced vertical rods, the vertical rods having lower ends for supporting the horizontal rod above the ground, a pivotal target frame mounted between the two vertical rods, a second shaft journaled for rotation adjacent the upper end of one vertical rod and being responsive to the swinging action of the pivotal target frame, a second arcuate cam mounted on the second rotatable shaft, a second microswitch mounted on said one vertical rod adjacent the second cam and being actuated by the second cam upon a predetermined rotary movement of the second shaft in response to the pivotal movement of the target frame whereby, upon pivotal movement of the target frame in response to an impact from a missile, the second microswitch will send a signal to the timer to stop the same.

4. A turnstile operated game as set forth in claim 1 wherein the means responsive to the completion of an ending event comprises a target including a horizontal rod having opposite ends connected to upper ends of a pair of spaced vertical rods, the vertical rods having lower ends for supporting the horizontal rod above the ground, a pivotal target frame mounted between the two vertical rods, a second shaft journaled for rotation adjacent the upper end of one vertical rod and being responsive to the swinging action of the pivotal target frame, a second arcuate cam mounted on the second rotatable shaft, a second microswitch mounted on said one vertical rod adjacent the second cam and being actuated by the second cam upon a predetermined rotary movement of the second shaft in response to the pivotal movement of the target frame whereby, upon pivotal movement of the target frame in response to an impact from a missile, the second microswitch will send a signal to the timer to stop the same.

5. A turnstile operated game as set forth in claim 1 wherein the turnstile is mounted on a target member, the target member being comprised of a horizontal pipe having opposite ends connected to upper ends of a pair of spaced vertical pipes, the vertical pipes having lower ends for supporting the horizontal pipe in spaced relation to the ground, a second shaft being rotatably mounted on one of the vertical pipes adjacent the upper end thereof, the cam being mounted on the second shaft for rotation therewith, the microswitch being mounted on the said one vertical pipe adjacent the cam, a pivotal target frame mounted between the two vertical pipes, the pivotal target frame having an upper end connected to said second shaft for rotation therewith, a horizontal arm extending outwardly from said one vertical pipe, said vertical shaft being rotatably mounted on the horizontal arm, a horizontal rod connected to the second portion of said lever and extending from said vertical shaft towards said one vertical pipe, a vertical rod extending downwardly from said second shaft and being rotatable therewith, said vertical rod having a lower end adapted to intercept the swinging path of movement of the horizontal rod whereby, when a person walks through and past the first portion of the lever, the horizontal rod will contact the vertical rod to pivot the second shaft and actuate the microswitch for sending a signal to the timer.

6. A turnstile operated game as set forth in claim 5 wherein a second turnstile is mounted on the target member, a third shaft being rotatably mounted on the other of the vertical pipes adjacent the upper end thereof, the upper end of the pivotal target frame also being connected to said third shaft for rotation therewith, a second horizontal arm extending outwardly from said other vertical pipe, a fourth shaft being rotatably mounted on the second horizontal arm for rotation on a vertical axis, a second horizontal lever connected to an upper end of the fourth shaft and having a first portion extending away from and beyond the other vertical pipe, the second lever having a second portion extending on the opposite side of the fourth shaft towards said other pipe, resilient means connected from the second portion of the second lever to the other vertical pipe to return the second lever to its initial position after the second lever has been deflected by a person walking through and past the second lever, a second horizontal rod connected to the second portion of the second lever and extending from said fourth shaft towards said other vertical pipe, a second vertical rod extending downwardly from said fourth shaft and being rotatable therewith, said second vertical rod having a lower end adapted to intercept the swinging path of movement of the second horizontal rod whereby, when a person walks through and past the first portion of the second lever, the second horizontal rod will contact the second vertical rod to pivot the third shaft to swing the pivotal target frame, thereby pivoting the second shaft to actuate the microswitch for sending a signal to the timer.

7. A turnstile operated game for determining the elapsed time between a starting event and an ending event comprising a turnstile composed of a horizontal member supported above the ground, a vertical shaft rotatably mounted on the horizontal member, an arcuate cam mounted on the turnstile and being responsive to the rotation of the shaft, a microswitch mounted on the turnstile adjacent the cam, the microswitch having a toggle arm adapted to be contacted by the cam to actuate the microswitch upon a predetermined rotary movement of the shaft, a horizontal lever connected to the vertical shaft and having a first portion extending away the shaft, the lever having a second portion extending on the opposite side of the shaft from the first portion thereof, resilient means connected from the second portion of the lever to the turnstile for returning the lever to its initial position after the lever has been deflected by an object contacting the first portion of the lever whereby, when the object contacts and pivots the first portion of the lever, the cam will turn to actuate the microswitch, a timer connected to the microswitch such that the timer is turned on when the object contacts and pivots the first portion of the lever, the contacting and pivoting of the first portion of the lever by the object constituting a starting event for the game, means responsive to the completion of an ending event to send a signal to the timer and stop the same, thereby indicating the time elapsed between the starting event and the ending event.

8. A turnstile operated game as set forth in claim 7 wherein the horizontal member is comprised of a horizontal pipe, wherein the horizontal pipe is supported above the ground by means of a vertical pipe, the vertical shaft being rotatably mounted on the horizontal pipe and having an upper end extending above the horizontal pipe and a lower end extending below the horizontal pipe, the arcuate cam being mounted on one end of the vertical shaft, the microswitch being mounted on the horizontal pipe adjacent the cam.

9. A turnstile operated game as set forth in claim 8 wherein the means responsive to the completion of an ending event comprises a target including a horizontal rod having opposite ends connected to upper ends of a pair of spaced vertical rods, the vertical rods having lower ends for supporting the horizontal rod above the ground, a pivotal target frame mounted between the two vertical rods, means responsive to pivotal movement of the target frame resulting from an impact from a missile, to send a signal to the timer to stop the same.

10. A turnstile operated game as set forth in claim 7 wherein the turnstile is mounted on a target member, the target member being comprised of a horizontal pipe having opposite ends connected to upper ends of a pair of spaced vertical pipes, the vertical pipes having lower ends for supporting the horizontal pipe in spaced relation to the ground, a pivotal target frame mounted between the two vertical pipes, wherein the horizontal member extends outwardly from one of the vertical pipes, and wherein the second portion of said lever extends behind and parallel to the pivotal target frame.

* * * * *